US006470901B1

(12) United States Patent
Scherer

(10) Patent No.: US 6,470,901 B1
(45) Date of Patent: Oct. 29, 2002

(54) TENT

(75) Inventor: Michael Scherer, Boulder, CO (US)

(73) Assignee: American Recreation Products, Inc., St. Louis, MO (US)

( * ) Notice: Subject to any disclaimer, the term of this patent is extended or adjusted under 35 U.S.C. 154(b) by 0 days.

(21) Appl. No.: 09/564,129

(22) Filed: May 3, 2000

(51) Int. Cl.[7] ..... E04H 15/40

(52) U.S. Cl. ..... 135/136; 135/121; 135/124; 135/125; 135/123

(58) Field of Search ..... 135/136, 121, 135/124, 125, 128, 138, 120.1, 120.3, 161, 135, 123, 115, 119; 403/392, 396, 399, 480

(56) References Cited

U.S. PATENT DOCUMENTS

| | | | | |
|---|---|---|---|---|
| 3,424,178 A | | 1/1969 | Yazaki | |
| 3,909,993 A | | 10/1975 | Huddle | |
| 4,265,259 A | | 5/1981 | Gillis | |
| 4,269,210 A | | 5/1981 | Marks | |
| 4,308,647 A | | 1/1982 | Gillis | |
| 4,827,958 A | | 5/1989 | Cantwell et al. | |
| 4,877,044 A | | 10/1989 | Cantwell et al. | |
| 5,080,119 A | | 1/1992 | Scherer | |
| 5,197,505 A | | 3/1993 | Tate | |
| 5,421,355 A | | 6/1995 | Cantwell | |
| 5,651,633 A | | 7/1997 | Howe | |
| 5,771,912 A | * | 6/1998 | Swetish | 135/97 |
| 5,901,727 A | | 5/1999 | Kramer et al. | |

FOREIGN PATENT DOCUMENTS

| | | | | |
|---|---|---|---|---|
| FR | 2684404 A1 | * | 11/1991 | 135/87 |

OTHER PUBLICATIONS

Sierra Design, Internal Guys, Date and Place of Publication Unknown, Admitted Prior Art.

* cited by examiner

*Primary Examiner*—Beth A. Stephan
(74) *Attorney, Agent, or Firm*—Senniger, Powers, Leavitt & Roedel

(57) ABSTRACT

A tent comprises a shell and a frame comprising a plurality of poles extending over the shell holding the shell up in an erect configuration in which the shell encloses a living space. Tension-taking trussing extends between the poles on the exterior of the shell to stabilize the tent.

37 Claims, 8 Drawing Sheets

TENT

BACKGROUND

This invention relates to tents, and more particularly to stabilized constructions for tents, including constructions having a fly (called a "rainfly"), rainflies and components used in said constructions, and methods of applying a rainfly to a tent structure.

Certain prior schemes aimed at strengthening tents have generally involved utilization of internal trussing, i.e. trussing within the living space of the tent, as for example shown in U.S. Pat. No. 5,901,727. Such schemes encroached on the living space, and occupants could easily become entangled with the trussing.

So-called "double-wall" tents comprise a frame, an inner wall or fabric shell supported by the frame, and an outer wall or fly which overlies the frame and fabric shell to inhibit rain from falling on the shell. Flies are typically fastened only at the bottom edge margin thereof, leaving the body of the fly unattached to either the frame or shell. While some flies are tethered to the tent at a point or points on the body of the fly, tethers are inconvenient in that they are attached to the inner surface of the fly and, therefore, must be fastened to the tent from the underside of the fly. More importantly, these tethers still allow the body of the fly to move relative to the frame. Thus, in conventional double-wall tents, air may enter the gap between the fly and the shell and force the fly outward thereby destabilizing the tent.

Typically, there is a space or "stand-off" between the frame and the shell of the tent. The stand-off is advantageous in that the fly, which overlies the frame, does not contact the shell and water on the inner surface of the fly does not contact the shell. However, the stand-off allows the frame a substantial range of motion with respect to the shell, which makes the tent less stable. Also, the fabric shell and fabric fly are both made of woven fabric panels having parallel warp yarns and parallel weft yarns, the warp yarns and weft yarns being oriented substantially perpendicular to one another. The fly and the shell are capable of stretching under load only slightly along the axes of the warp and weft yarns, but can stretch much more significantly under load along axes oblique to the warp and weft yarns. Such stretching also makes the tent less stable, which may become a problem in high winds. Prior art attempts to stabilize the poles have either been inconvenient to install on the tent or, as mentioned above, have intruded into the living space of the tent.

SUMMARY OF THE INVENTION

Among the several objects of the invention may be noted the provision of a tent which is relatively stable and resistant to wind; the provision of such a tent which is easy to assemble; the provision of such a tent in which structure for stabilizing the tent does not encroach on the living space of the tent; the provision of such a tent which is compact when disassembled; the provision of such a tent having a rainfly thereon which is securely attached to the tent; the provision of such a tent having a rainfly which prevents substantial moisture from falling on the shell of the tent; the provision of such a tent having a reinforced rainfly which aids in stabilizing the tent; and the provision of such a tent which is economical to fabricate.

Further among the objects of the invention may be noted the provision of a fly for use with a tent which is adapted to inhibit water from contacting a shell of the tent and the provision of such a fly which is adapted to be securely fastened to the tent.

Still further among the objects of the invention may be noted the provision of a clip for attaching a fly to a tent which is easy to use and the provision of such a clip which is economical to manufacture.

Still further among the objects of the invention may be noted the provision of a method of securing a fly on a tent which is securely fastens the body of the fly to the tent and the provision of such a method which is easy to perform.

Briefly, a tent of this invention comprises a shell and a frame comprising a plurality of poles extending over the shell holding the shell up in an erect configuration in which the shell encloses a living space. Tension-taking trussing extends between the poles on the exterior of the shell to stabilize the tent.

In another aspect of the invention, the tent comprises a shell, a frame comprising a plurality of poles supporting the shell in an erect configuration in which the shell encloses a space sized to accommodate one or more occupants, a fly overlying the shell and frame, and a clip securing the fly to a pole of said plurality of poles. The clip comprises a body having opposite ends, and a recess in the body extending from one end of the body to the other end. The pole and an overlying portion of said fly are held captive in the recess with the pole extending longitudinally through the recess and the overlying portion of the fly being disposed between the pole and the clip.

In yet another aspect of the invention, a fly for use with a tent having a fabric shell and a frame including a plurality of poles for supporting the shell in an erect configuration in which the shell encloses a space sized to accommodate one or more occupants comprises a fabric member sized and shaped to overlie the shell. A patch is attached to the fabric member and disposed on the fabric member to overlie a pole of said plurality of poles. The patch is capable of conforming to a shape of said pole. A clip has a recess for receiving and holding captive the patch, the fabric member and said pole thereby to secure the fly to the frame. The patch occupies sufficient volume in the recess to ensure a snug fit between the clip, the patch, the fabric member and said pole.

In still another aspect of the present invention, a clip for attaching a fabric fly to a tent having a fabric shell and a frame having poles comprises a body having opposite ends, a recess extending completely through the body from one end to the other end, and a slot extending the length of the body providing access to said recess. The slot and recess are sized and configured so that the clip can be moved into engagement with an outside surface of a portion of the fly overlying said pole and then pushed inwardly to cause said overlying portion of the fly and said pole to pass through the slot and into the recess to an overlying position in which the pole extends longitudinally through the body and said overlying portion of the fly is disposed between the pole and the body.

In yet another aspect of the present invention, a method of securing the fly to the tent comprises the steps of providing a clip having a body with opposite ends, a recess in the body extending completely through the body from one end to the other end, and a slot extending the length of the body providing access to said recess. The clip is moved into engagement with an outside surface of a portion of the fly overlying a pole. The clip is pushed inwardly toward the interior of the tent to cause said overlying portion of the fly and the pole to pass through the slot and into the recess to an initial position in which the pole extends longitudinally through the body and said overlying portion of the fly is disposed between the pole and the body. The clip is slid along the pole to a final position in which a patch on the outside surface of the fly is also received in the recess and occupies a space sufficient to prevent withdrawal of the pole and fly from the clip thereby to secure the fly to the pole.

In yet another aspect of the invention, the tent comprises a fabric shell and a frame having a first pole and a second pole supporting the shell in an erect configuration in which the shell encloses a space sized to accommodate one or more occupants, one pole crossing over the other at a crossover point. A first sleeve receives said first pole and is attached to the shell, and a second sleeve receives said second pole and is attached to the shell. A connector connects said first sleeve to said second sleeve at or generally adjacent said crossover point for stabilizing said first pole and second pole relative to one another.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
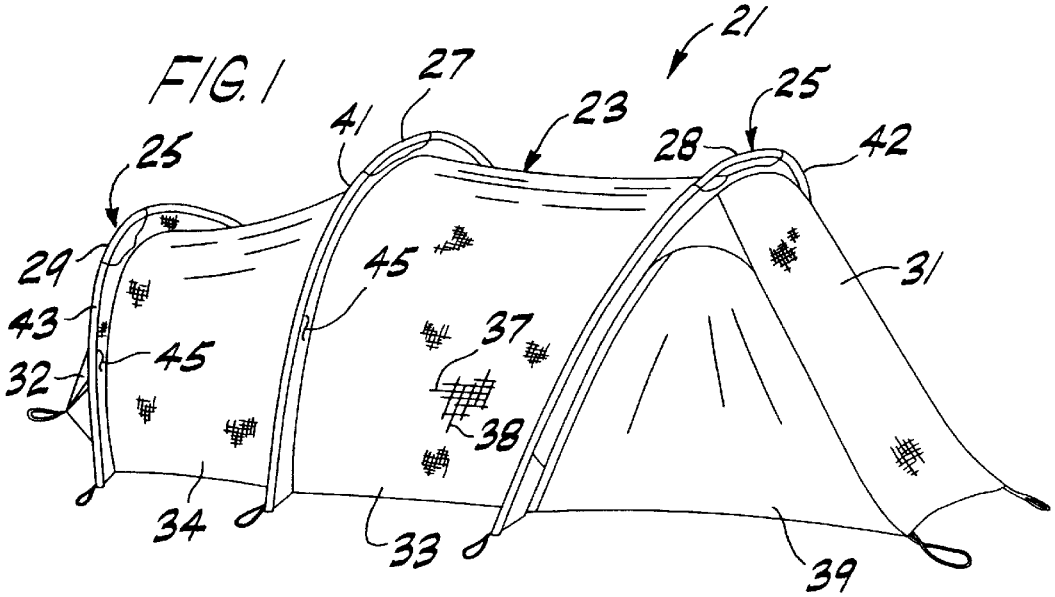
FIG. 1 is a perspective showing a shell of a tent erected on three poles and omitting a fly (which is applied over the shell)

Referring first in particular to FIG. 1 of the drawings, there is shown a tent generally designated by the reference numeral 21 comprising a fabric shell generally designated 23 and a frame generally designated 25 comprising a intermediate pole 27, forward pole 28 and rear pole 29 supporting the shell in an erect configuration in which the shell encloses an interior space sized to accommodate one or more occupants. The tent 21 is suitably anchored by stakes (not shown) extending through fabric loops attached to the base of the shell. Different types of shells and frames are envisioned, the tent shown being merely an example of a tent such as may be involved in this invention.

Figure 4:
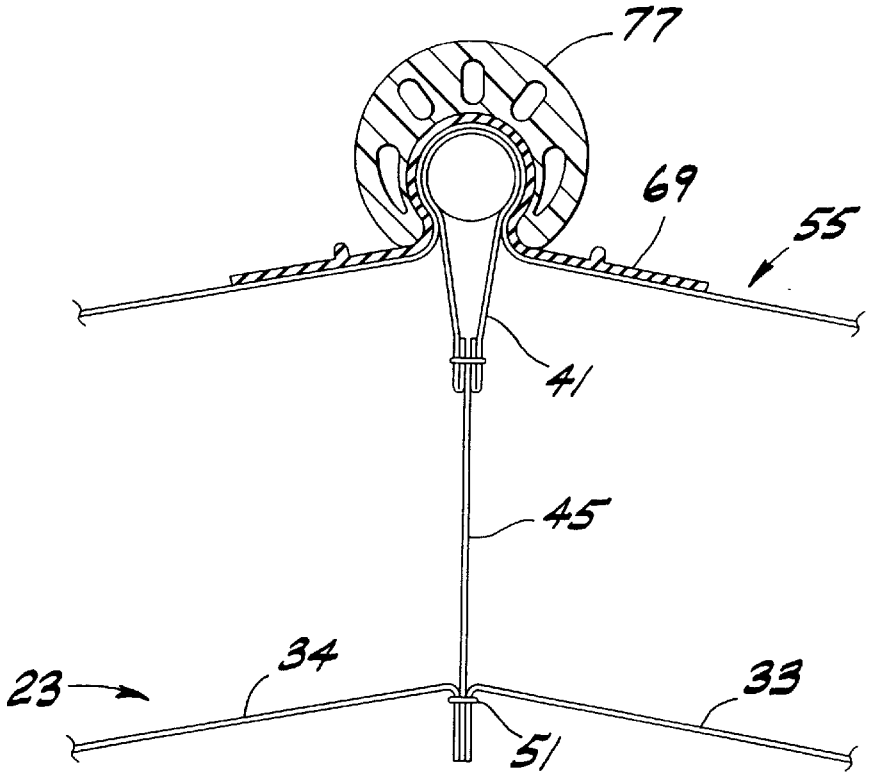
FIG. 4 is a view generally in section on line 4—4 of FIG. 3.
Figure 5:
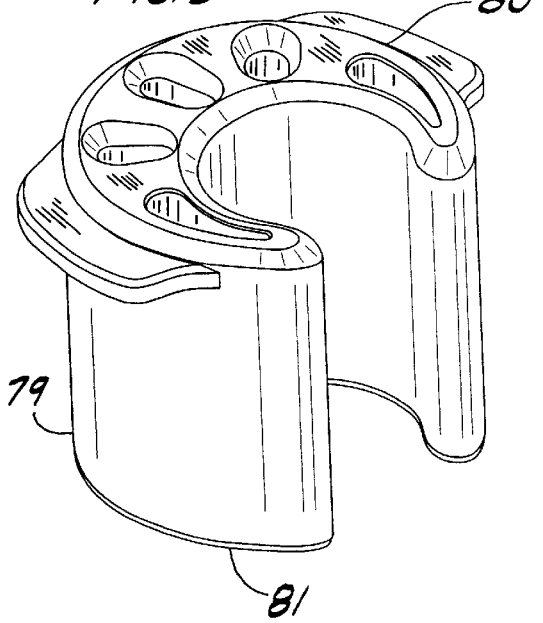
FIG. 5 is a perspective of the clip.
Figure 6:
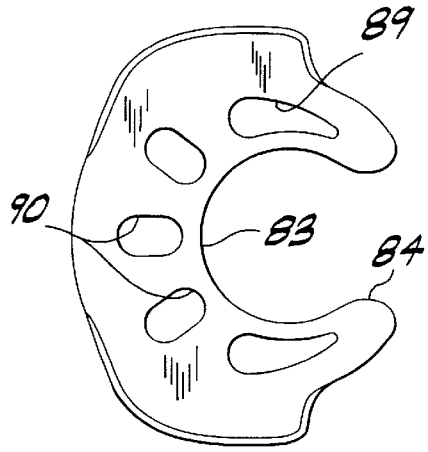
FIG. 6 is an end elevation of the clip.

The fabric shell 23 is made of woven fabric panels, e.g., end panels 31, 32 and two intermediate panels 33 and 34, each having parallel warp yarns 37 and parallel weft yarns 38, the warp yarns and weft yarns being oriented substantially perpendicular to one another. A door panel 39 is interposed between end panel 31 and intermediate panel 33. The warp yarns 37 extend generally horizontally or parallel to the ground, and the weft yarns 38 extend generally vertically, though this relation could be reversed. The shell includes intermediate sleeve 41, forward sleeve 42 and rear sleeve 43, each suitably attached to a fabric spacer 45 for receiving the three poles 27, 28, 29 of the frame. The poles extend through the sleeves 41, 42, 43 and are each bent into an arch shape when the tent 21 is in the erect configuration. The poles 27, 28, 29 are conventional poles circular in cross-section, though other shapes are contemplated. As shown in FIG. 4, the sleeve 41 is attached, as by sewing, to an upper edge spacer 45. The lower edge of the spacer is attached to panels 33, 34 of the shell 23 at a sewn seam 51 connecting the panels. The other sleeves are similarly attached to the shell. Thus, the sleeves 41, 42, 43 and the poles extending therethrough are spaced from the panels constituting the shell 23.

Figure 2:
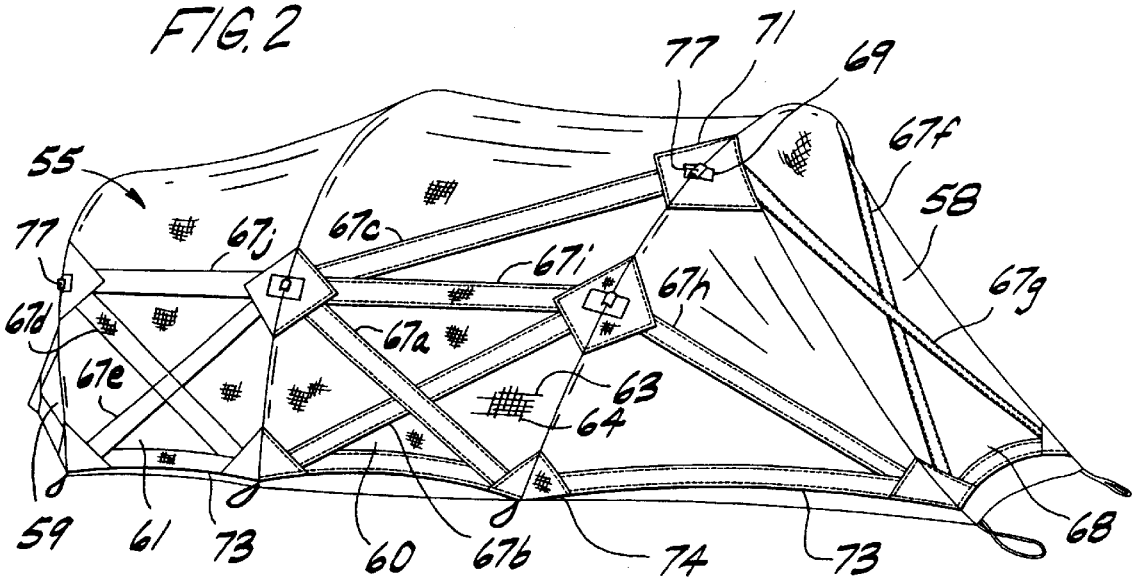
FIG. 2 is a perspective showing the fly of this invention overlying the FIG. 1 shell.
Figure 7:
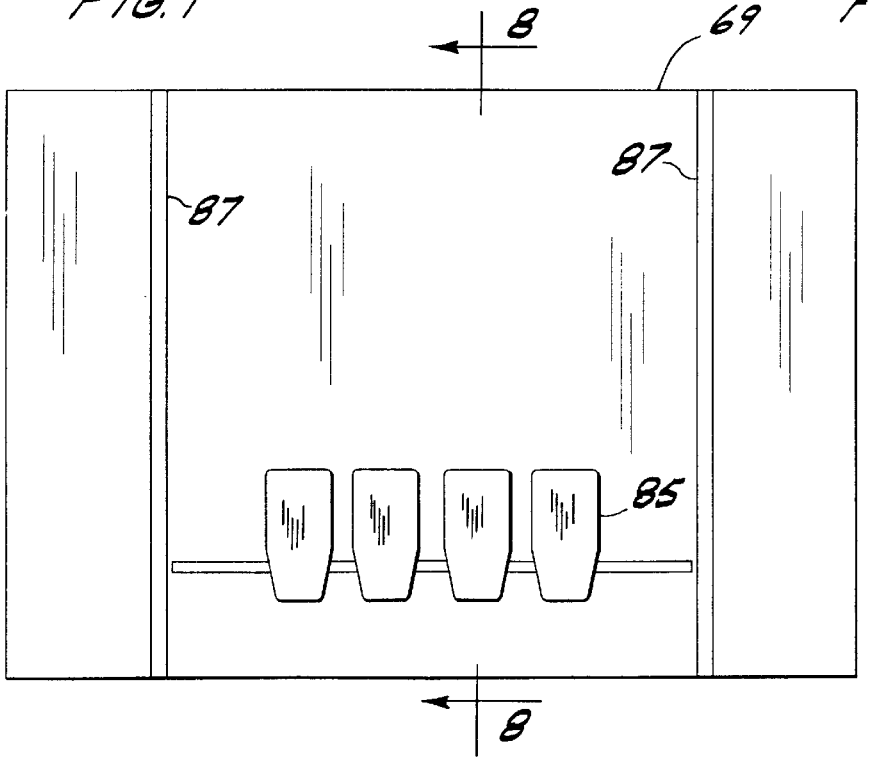
FIG. 7 is a plan view of a patch.
Figure 8:
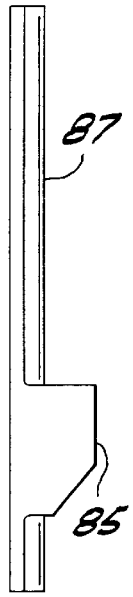
FIG. 8 is a view generally in section on line 8—8 of FIG. 7.

Referring to FIG. 2, the tent is provided with a fly generally designated 55 which overlies the shell 23 and frame 25 substantially to prevent moisture from falling on the shell. The fly 55 comprises a fabric member made of polyester or other suitable material which is sized and shaped to overlie the tent 21. The fabric member in this embodiment comprises a plurality of woven fabric panels, e.g. end panels 58, 59 and two intermediate panels 60, 61 each comprising parallel warp yarns 63 and parallel weft yarns 64, the warp yarns and weft yarns being oriented substantially perpendicular to one another. The warp yarns 63 extend generally horizontally or parallel to the ground, and the weft yarns 64 extend generally vertically. The fly 55 is capable of stretching under load only slightly along the axes of the warp yarns 63 and weft yarns 64, but can stretch more significantly under load along axes oblique to the warp and weft yarns. Tension-taking reinforcing chords 67*a–j* (broadly, trussing) on the fly extend between the poles 27, 28, 29 and the base of the shell 23 to stabilize the tent. Preferably, chords 67*a–h* extend obliquely with respect to the warp yarns and the weft yarns to reinforce the panel along axes where it is most likely to stretch under load. Chords 67*i,j* extend horizontally between patches 69, parallel to the warp yarns 63, to further reinforce the fly 55, though such reinforcement may be omitted. Preferably, chord 67*c* extends upward from adjacent an intermediate pole 27 to the upper portion of the shell 23 generally adjacent forward pole 28 to reinforce the upper portion of the tent. Also preferably, chords 67*f,g* extend downward from adjacent forward pole 28 to the bottom edge margin 68 of the fly 55. Preferably, the chords 67*a–j* extend between and under diamond-shaped reinforcement swatches 71, each swatch generally disposed over one of the seams and one of the poles 27–29. The swatches 71 aid in securing the panels 58–61 together. Preferably, patches 69 (one of which is shown in detail in FIGS. 7 and 8) are attached, as by an adhesive or by sewing, to the reinforcement swatches 71 and disposed to overlie one of the poles 27–29. Each patch 69 is made of rubber or other flexible material so that it may conform to the shape of the pole. As shown in FIG. 2, the fly 55 also includes reinforcing bands 73 and triangle-shaped reinforcement swatches 74 along its bottom edge margin to prevent tearing of the fly.

Figure 3:
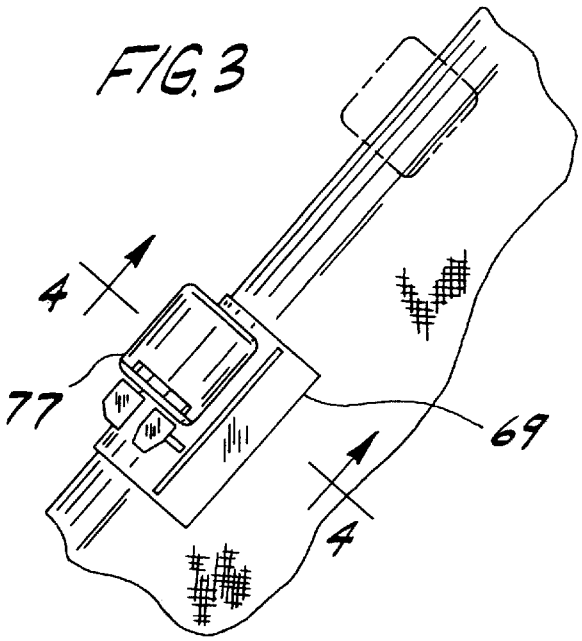
FIG. 3 is a fragmentary side elevation showing a clip on the fly in accordance with this invention.

Referring to FIGS. 2–6, the fly 55 is secured to the shell by conventional buckles (not shown) along its bottom edge margin 68. Clips 77 of this invention secure the central body of the fly 55 to at least one of the poles 27–29. Each clip 77 comprises a generally cylindrical body 79 having opposite ends 80, 81 and a recess 83 in the body extending completely through the body from one end to the other end. A slot 84 extends the length of the body to provide access to the recess 83. The recess has a generally circular cross-section complementary to the generally circular cross-section of the poles 27–29. Describing the clip with reference to FIGS. 3 and 4 showing the clip overlying intermediate pole 27, the recess 83 and slot 84 are sized and configured so that the clip 77 can be moved into engagement with an outside surface of a portion of the fly 55 overlying the pole 27, constituting an initial position as shown in phantom in FIG. 3. In other words, the slot has sufficient width to receive the pole 27, sleeve 41 and fly 55 without significant flexure of the clip. In the initial position, the pole 27 and the overlying portion of the fly 55 are held loosely in the recess 83, and the pole extends longitudinally through the clip 77. The clip is slidably movable along the pole 27 from the initial position to a final position shown in solid lines in FIG. 4 in which the overlying portions of the patch 69, the sleeve 41 and the fly 55 are snugly received and held captive in the recess 83 (see also FIG. 4). The patch 69 occupies sufficient volume or bulk to ensure a snug fit between the clip 77, the fly 55 and the pole 27 and to prevent withdrawal of the pole and the fly from the clip thereby to secure the fly to the pole along the central body of the fly. Importantly, the fabric member constituting the fly 55 is "gathered" within the recess 83 so as to increase the tension in the fly, and preferably to increase the tension in the reinforcing chords 67*a–j* of the fly, and thereby more effectively stabilize the pole 27 relative to the other poles 28, 29. Referring to FIG. 3 and to FIGS. 7–8, the patch 69 includes stops 85 which substantially prevent sliding movement of the clip 77 relative to the pole 27 when the clip is in the final position. Note that the stop may be located other than on the patch 69, for example on the pole 27. Ribs 87 along the edge margins of the patch also prevent sliding movement. At least two clips 77 (one on either side of the tent) are preferably mounted on each pole 27–29 so that there is sufficient tension in the fly 55 to stabilize the poles relative to one another. Also, provision of several clips 77 will more securely fasten the central body of the fly 55 to the frame 25 to make the tent 21 more wind-resistant. However, it is contemplated that any number of clips 77 may be used.

Referring again to FIGS. 5 and 6, each clip 77 is suitably made as a one-piece body of material, such as plastic, though other materials are contemplated. The material has sufficient rigidity so that the clip 77 can only be removed by sliding the clip from the final position to the initial position. Thus, the clip will not become disengaged under increased tension in the fly 55. The clip has at least one aperture 89 extending longitudinally therethrough. A tether cord (not shown) permanently attached to the shell 23 may extend through the aperture 89 for tethering the clip 77 to the fly 55. The tether cord prevents separation of the clip 77 from the fly 55 when the clip is not secured to the pole, e.g., when the tent is disassembled. The clip 77 also has longitudinal openings 90 for receiving guy lines (not shown) which may be anchored to the ground for anchoring the fly 55, frame 25 and shell 23 to the ground.

In a method of securing the fly 55 to the tent 21, the fly is placed over the shell 23 and poles 27–29 and is positioned so that the patches 69 overlie respective poles. The male elements of buckles (not shown) at the bottom edge margin are mated with female elements of buckles (not shown) attached to the bottom edge margin of the shell 23. Referring again to FIG. 3 and describing the clip 77 over pole 27, the clip is moved into engagement with the portion of the fly 55 overlying the pole and is pushed inwardly toward the interior of the tent 21 to cause the fly and the pole to pass through the slot and into the recess to an initial position in which the pole extends longitudinally through the body 79 of the clip 77 and the overlying portion of the patch and fly are disposed between the pole and the body. The clip 77 is slid along the pole to the final position in which the clip engages the stop 85 of the patch 69. In the final position, the patch 69 is also received in the recess 83 and occupies a volume sufficient to prevent withdrawal of the pole 27 and fly 55 from the clip thereby to secure the fly to the pole. The other clips 77 are attached to the respective poles 27, 28, 29 in the same manner. It is to be noted that the fly 55 may be used without the clips 77, but that it is preferred that the clips be mounted on the poles.

Figure 9:
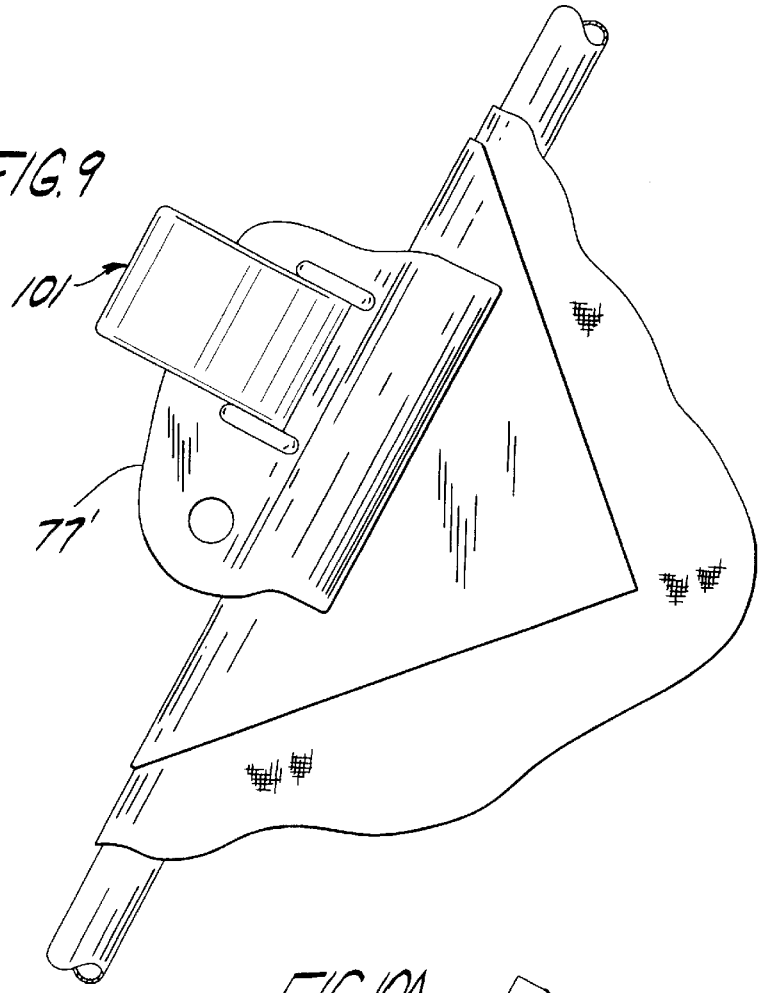
FIG. 9 is a view similar to FIG. 3 showing a second embodiment of the clip with portions of the fly removed for clarity.
Figure 10:
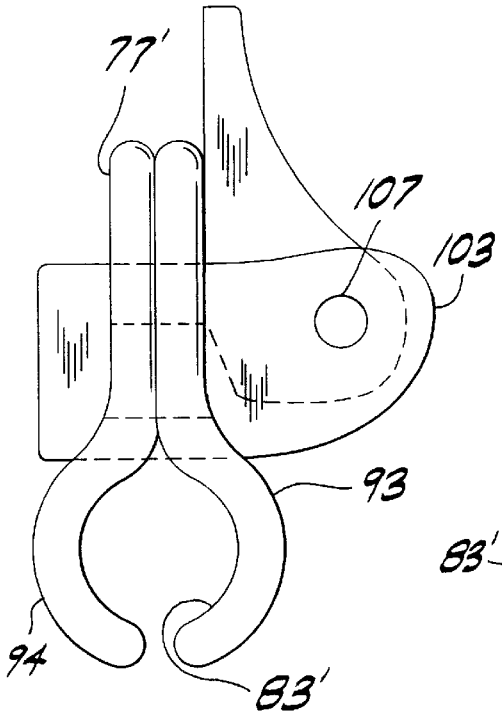
FIG. 10 is an end elevation of the second embodiment of the clip.
Figure 10A:
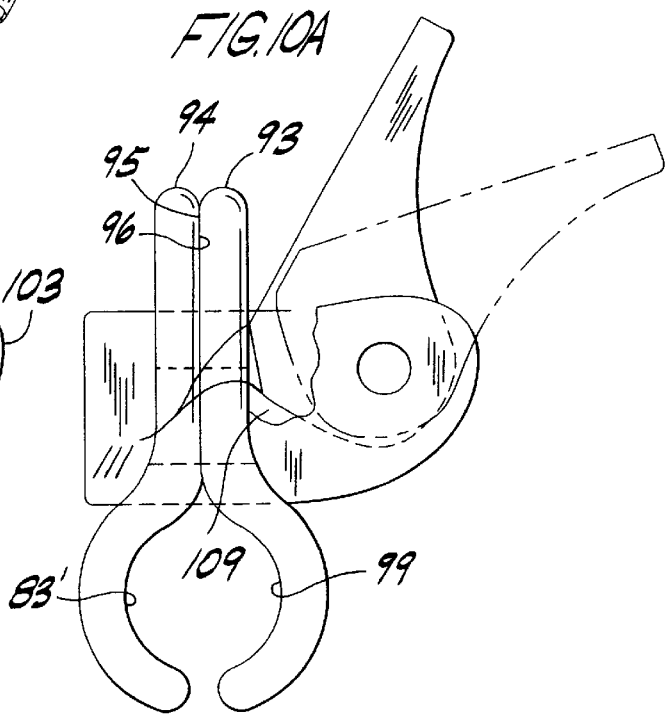
FIG. 10A is an enlarged end elevation of the second embodiment of the clip in a center position and showing an unlocked position in phantom.
Figure 11:
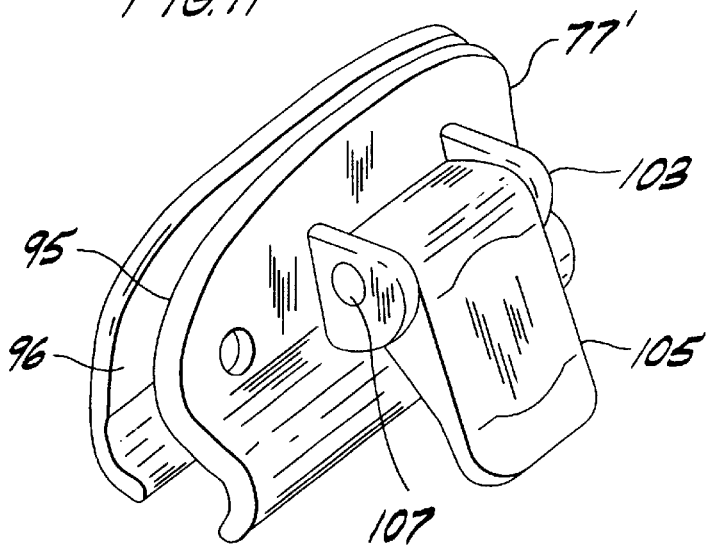
FIG. 11 is a perspective of the second embodiment of the clip in the unlocked position.

Referring to FIGS. 9–11, in an alternative embodiment, the body of the clip 77' comprises two jaws 93, 94 movable from an open position to a clamped position. Jaw 93 includes a flat section 95 engageable with the flat section 96 of the other jaw 94 when the clip 77' is in the clamped position, as shown in FIGS. 9–11. Each jaw also includes an arcuate section 99, the recess 83' being defined between the arcuate sections. Each arcuate section 99 preferably has a shape complementary to the shape of the pole. In the open position shown in FIG. 11, the jaws 93, 94 are spaced apart to define the slot 83' and the clip 77' is movable to the initial position in which the pole 27 and the overlying portion of the fly 55 are held loosely in the recess and the pole extends longitudinally through the clip. The jaws 93, 94 are movable to the clamped position in which the jaws are closer together than in the open position. A locking mechanism generally designated 101 locks the jaws in the clamped position to prevent withdrawal of the pole 27 and fly 55 from the clip thereby to secure the fly to the pole. A suitable locking mechanism 101 includes arms 103 extending from flat section 96 of jaw 94 through the flat section 95 of jaw 93, and a lever 105 eccentrically mounted on the arms, such as by a pin 107. The lever 105 is movable from an unlocked position (FIG. 11) through a center position (FIG. 10A) to an over-center or locked position (FIG. 10). In the unlocked position, the jaws 93, 94 are movable to the open position to receive the fly 55 and the pole 27. The lever 105 may thereafter be rotated toward the locked position (counter-clockwise, as shown in FIG. 10A) so that a cam surface 109 of the lever 105 engages jaw 93 and thereby forces the jaws together to the closed position. The cam surface 109 preferably has ridges 111 (which are exaggerated in FIG. 10A) shaped so that, as the lever 105 rotates, an unstable center position is reached when each ridge contacts the flat section. In the center position, the jaws 93, 94 are compressed or squeezed close together so that they exert a return force on the cam surface. From the center position, the lever 105 is rotated even more in the counter-clockwise direction to the locked position, in which the jaws 93, 94 are slightly further apart than in the center position. Thus, in the locked position, the lever 105 may only be rotated back to the center position (clockwise) if a predetermined amount of force is applied to the lever to overcome the ridge 111 and the friction between the cam surface and the jaw 93.

Figure 12:
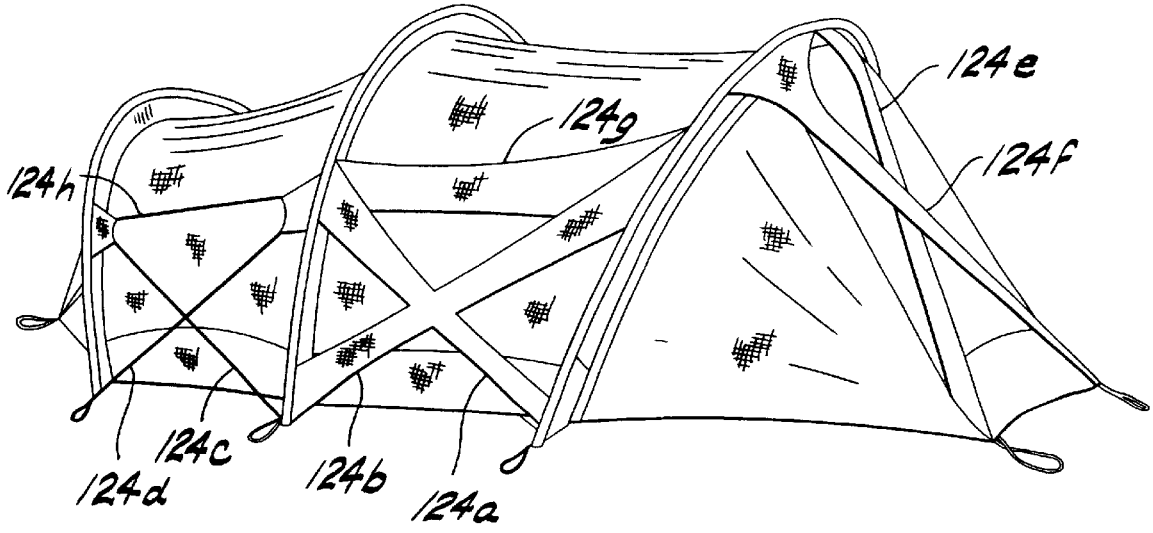
FIG. 12 is a perspective of a tent shell of the invention as erected.
Figure 13:
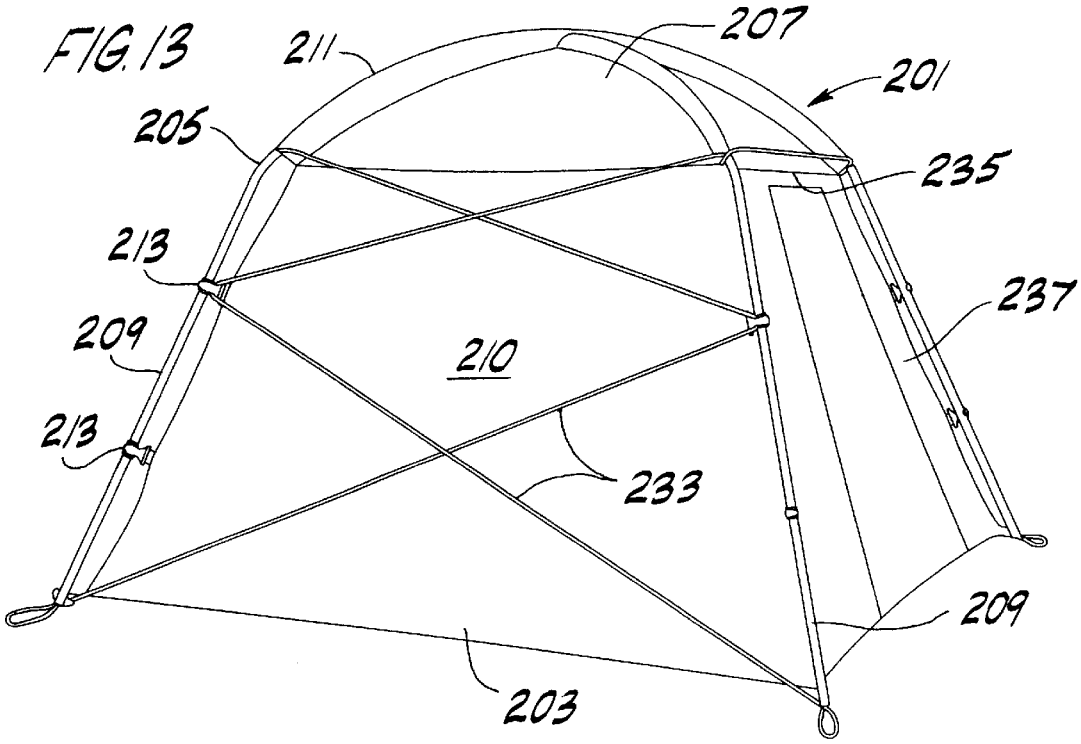
FIG. 13 is a perspective of a cabin tent of the invention.
Figure 14:
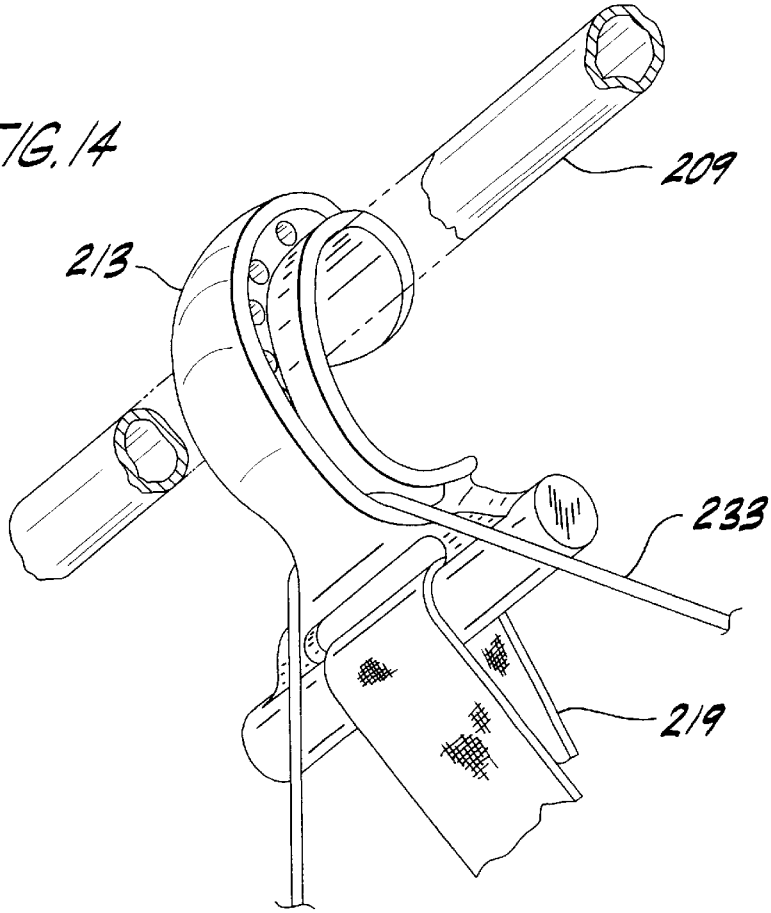
FIG. 14 is a fragmentary perspective of a hook of the cabin tent with portions of a pole omitted for clarity.
Figure 15:
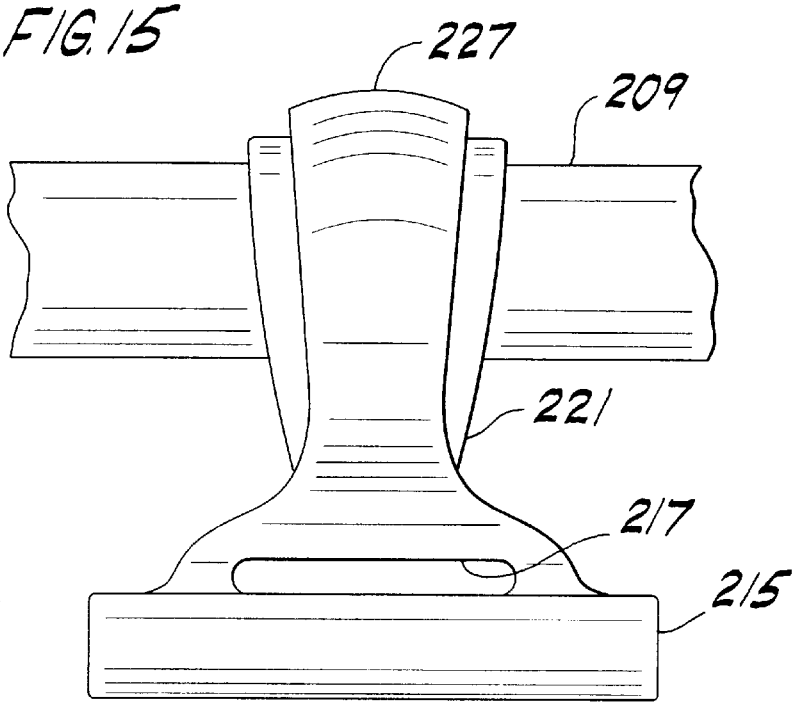
FIG. 15 is a side elevation of the hook.

In another embodiment of the invention shown in FIG. 12, the tent 21 includes several reinforcing chords 124*a–h* for exerting tensile force on the poles 27–29 when the tent is in the erect configuration to stabilize the poles and the tent. Each chord 124*a–h* extends from adjacent one of the poles 27–29 to positions on the tent remote from the respective pole, preferably to a position adjacent another of the poles. Each chord 124*a–h* is sized and shaped so that when the tent 21 is in the erect configuration, the chord is stretched relatively tightly to exert the tensile force. Preferably, each reinforcing chord 124*a–h* is permanently attached to the shell 23 and at least one end of each chord is attached as close as practical to one of the poles 27–29, as by sewing the end of the chord to one of the sleeves 41–43. Preferably, the reinforcing chords 124*a–h* extend obliquely with respect to the warp yarns 37 and the weft yarns 38 for the same reasons described above with respect to the fly. For example, reinforcing chord 124*b* extends from the base of sleeve 41 to a central section of sleeve 42 to stabilize the adjacent poles 27, 28 and the tent 21. Reinforcing chord 124*a* extends from the base of sleeve 42, crossing chord 124*b,* to a central section of sleeve 41 to further stabilize poles 27, 28. Likewise, criss-cross reinforcing chords 124*c,d* extend between the base of sleeve 41 and a central section of sleeve 43 and between the base of sleeve 43 and the central section of sleeve 41. Note that the criss-cross chords may be made integrally with each other of the same piece of material, or made of separate pieces of material. Reinforcing chords also extend from an upper section of sleeve 42 down to the bottom edge margin of the shell 23. Thus, the tent 21 is strengthened along axes oblique to the warp and weft yarns 37, 38. Moreover, tension in the chords 124*a–h* stabilizes the tent poles 27–29 relative to one another. Note that reinforcing chords 124*g,h* extending horizontally between poles further stabilize the poles but may be omitted. The chords 124*a–h* are positioned external to the living space of the tent 21 so that the trussing does not encroach into the living space and so that a user inside the tent cannot become entangled with the chords.

The reinforcing chords 67*a–j,* 124*a–h* of the fly and the shell, respectively, are suitably made of flexible materials such as fabric or cord which are stretch resistant and capable of taking tension forces, but not compression forces, in the tent 21. Such materials are advantageous, for among other reasons, they are more compact, of lighter weight and may be more easily deployed than, for example, a conventional tent pole. A preferred material is carbon fiber tape, which is significantly more stretch resistant than typical shell material. The reinforcing chords 67*a–j,* 124*a–h* may also be made of woven fabric material having parallel warp yarns or weft yarns extending lengthwise of the chord, but obliquely with respect to the warp yarns 37, 63 and the weft yarns 38, 64 of the shell and fly. Each reinforcing chord will, therefore, stretch less along its longitudinal axis than the shell or fly material when placed under load. The chords 67*a–j,* 124*a–h* may be attached to the fly 55 or shell 23 by suitable means such as sewing, or by adhesive bonding. The chords may be attached to the fly 55 or the shell 23 along their entire length, or they may be only attached at opposite ends, as shown in FIG. 12. It is further envisioned that the chords 67*a–j,* 124*a–h* may be integrated into the shell 23 or fly 55 such that the chord actually replaces a portion of the fabric constituting the shell or fly. Thus, preferably, the chords 67*a–j,* 124*a-h* are provided on the tent 21 without any effort of the user to deploy the chords.

The shell 23 of this embodiment (FIG. 12) may be used advantageously without the fly 55, but preferably the fly is installed thereon to further stabilize the tent 21.

Figure 16:
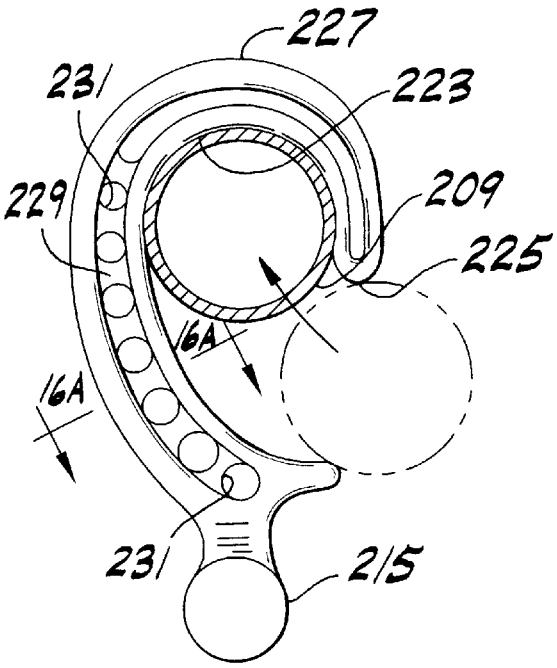
FIG. 16 is an end view of the hook, the pole shown in section and in phantom.
Figure 16A:
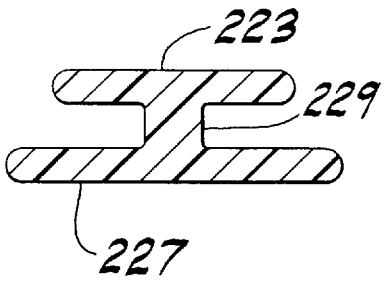
FIG. 16A is a section view on line 16A—16A of FIG. 16.

FIGS. 13–16A show another embodiment of a tent 201, more particularly, a cabin-type tent comprising a fabric shell 203 and a frame comprising curved pole sections 205 (which are substantially hidden by sleeves 211) along the roof 207 of the tent and straight pole sections 209 connected thereto and extending downward along side walls 210. The curved pole sections are inserted through the sleeves 211 extending upward from the roof. The straight pole sections 209 are secured to the side walls by rigid J-shaped hooks 213. Each hook includes a cylindrical gripping formation 215 and a slot 217 adjacent the formation. The hook 213 is secured to the tent 201 by a loop of fabric 219 attached to the shell 203 of the tent extending through the slot 217. The hook has an inner flange 221 which defines a recess 223 and a mouth 225 for receiving the pole 209, as shown in FIG. 16. The user grips the formation 215 and an outer flange 227 and inserts the pole 209 into the mouth 225, then pushes the pole upward until it contacts the bottom of the recess 223. The hook 213 is strengthened by the outer flange 227, which is joined to the inner flange 221 by a web 229. Openings 231 extend through the web parallel to the pole for receiving a guy line 233 (broadly, reinforcing chord). Preferably, two guy lines 233 extend upward from the base of the poles 209 across the side walls 210 and through one of the hooks 213, the lines crossing in the middle of the side wall. From the hooks 213, the lines extend upward to adjacent the roof line 235 of the tent, again crossing each other, to the curved pole sections 205 adjacent the sleeves of the roof. The lines 233 may be wrapped around the curved pole sections 205 and tied off, or more preferably, each line extends between curved pole sections along the roof line 235 of the tent 201 at the front wall 237 or back wall (not shown) of the tent. On the opposite side wall (not shown) of the tent, each line extends downward from the curved pole sections to identical hooks 213 on the opposite side wall so that the guy lines 233 on the opposite side wall are substantially identically configured as on the side wall shown. The lines 233 are "tied off" at the base of the pole sections 209 so that there is sufficient tension in the lines to stabilize the poles relative to one another. It is to be noted that the lines as described are not permanently attached to the tent 201 in this embodiment, though permanent attachment is contemplated. The guy lines 233 are preferably constituted by stretch resistant cord.

Figure 17:
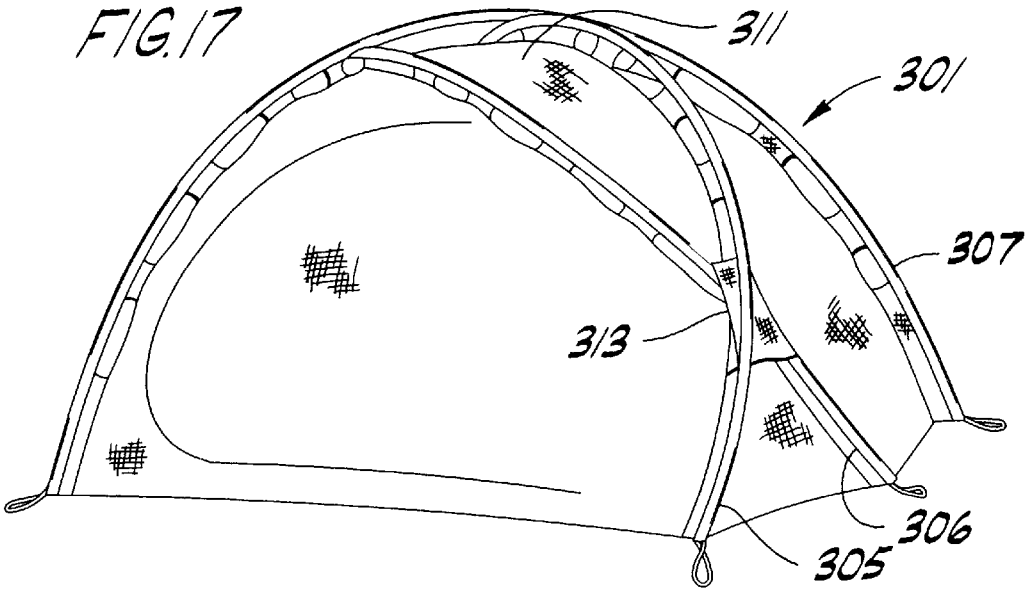
FIG. 17 is a perspective of a dome tent having a connector at a cross point.
Figure 18:
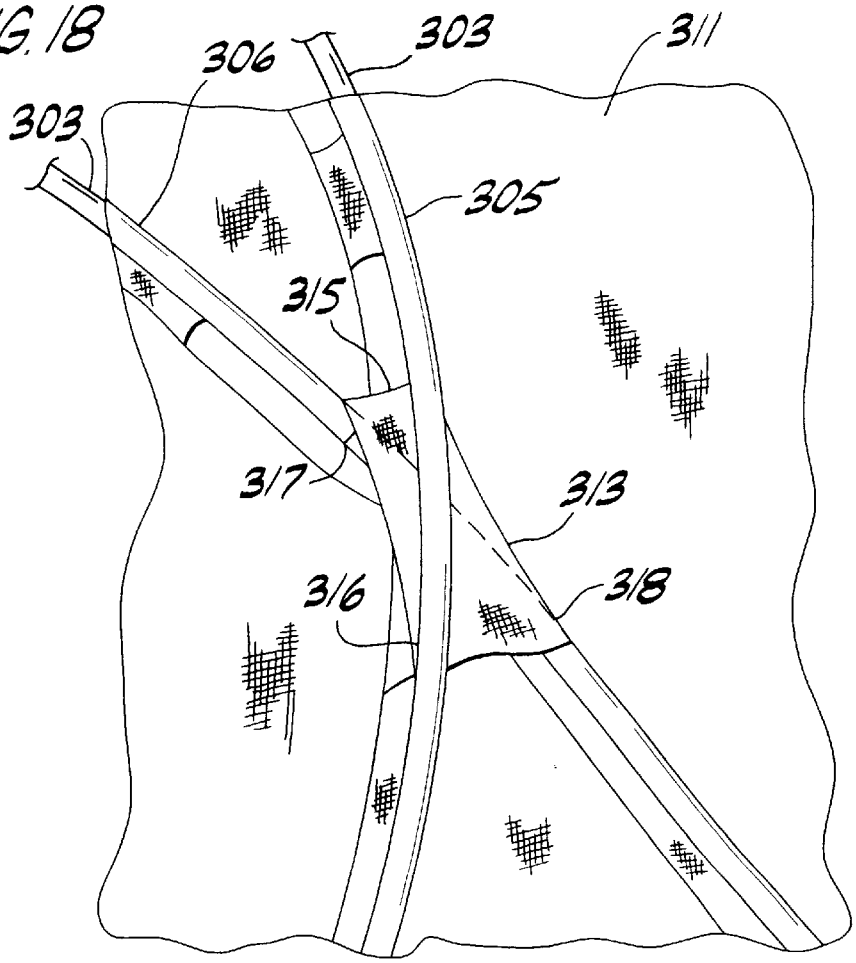
FIG. 18 is an enlarged perspective showing the connector of the dome tent.

FIGS. 17 and 18 illustrate a dome-type tent generally designated 301 comprising a frame including poles 303 extending through sleeves 305, 306, 307 which cross one another at crossover points on the tent. In the example shown the tent includes three poles, though it is envisioned that the invention may be used with a tent having any number of poles which cross over one another. The sleeves 305–309 are suitably attached to the shell 311 of the tent by webs. A connector 313 connects sleeve 305 to sleeve 306 at or generally adjacent the crossover point for stabilizing the poles 303 relative to one another. Preferably, the connector 313 comprises a flexible, generally rectangular fabric member which is stretch resistant, at least along axes parallel to its edges. Diagonal corners 315, 316 of the connector 313 are attached to the underside of sleeve 305 on opposite sides of the crossover point. The other two diagonal corners 317, 318 are attached to the upper side of sleeve 306, also at opposite sides of the crossover point. Preferably, the connector 313 is sewn to the respective sleeves 305, 306, the stitching extending inward on the connector from the corners as shown in FIG. 18. Thus, the connector securely connects the sleeves so that the poles extending through the sleeves are stabilized at the crossover, which makes the overall tent more stable.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A tent comprising:

a shell, a frame comprising a plurality of poles extending over the shell holding the shell up in an erect configuration in which the shell encloses a living space, and tension-taking trussing extending between the poles on the exterior of the shell to stabilize the tent and to inhibit the poles from moving away from one another.

2. A tent as set forth in claim 1 wherein the shell is made of woven fabric having parallel warp yarns and parallel weft yarns, the warp yarns and weft yarns being oriented substantially perpendicular to one another, the trussing extending obliquely with respect to the warp yarns and the weft yarns.

3. A tent as set forth in claim 2 wherein the trussing is permanently attached to a sleeve of the shell and is made of a stretch resistant fabric having parallel yarns extending obliquely with respect to the warp yarns and the weft yarns of the shell.

4. A tent as set forth in claim 3 wherein the trussing is capable of taking only tension forces and is not capable of taking compression forces.

5. A tent as set forth in claim 1 wherein the trussing is constituted by a guy line which is removably attached to the shell.

6. A tent as set forth in claim 1 further comprising a fly sized and shaped to overlie the tent and having said trussing attached thereto.

7. A tent as set forth in claim 6 wherein said fly is made of woven fabric having parallel warp yarns and parallel weft yarns, the warp yarns and weft yarns being oriented substantially perpendicular to one another, said trussing extending obliquely with respect to the warp yarns and the weft yarns.

8. A tent as set forth in claim 6 further comprising at least one clip for securement of the fly to said poles, each clip comprising a body having opposite ends, and a C-shaped recess in the body extending from one end of the body to the other end, said clip being adapted to be moved to a position in which said pole and an overlying portion of said fly are held captive in the recess with said pole extending longitudinally through the recess and the overlying portion of the fly disposed between said pole and the clip.

9. A tent as set forth in claim 1 wherein the trussing is capable of taking only tension forces and is not capable of taking compression forces.

10. A tent as set forth in claim 1 wherein the trussing extends substantially linearly between the poles.

11. A tent as set forth in claim 1 further comprising a plurality of hooks attached to the shell and securing said poles to the shell, each hook including openings receiving the trussing.

12. A tent as set forth in claim 11 wherein the hooks are J-shaped and include a gripping formation for gripping the pole.

13. A tent comprising:

a shell, a frame comprising a plurality of poles supporting the shell in an erect configuration in which the shell encloses a space sized to accommodate one or more occupants, a fly overlying the shell and frame, and a clip securing the fly to a pole of said plurality of poles, said clip comprising a body having opposite ends, and a recess in the body extending from one end of the body to the other end, said pole and an overlying portion of said fly being held captive in the recess with the pole extending longitudinally through the recess and the overlying portion of the fly being disposed between the pole and the clip.

14. A tent as set forth in claim 13 further having a second clip securing the fly to a second pole, said second clip comprising a body having opposite ends, and a recess in the body extending from one end of the body to the other end, said second pole and an overlying portion of said fly being held captive in the recess with the second pole extending longitudinally through the recess and the overlying portion of the fly being disposed between the second pole and the clip.

15. A tent as set forth in claim 14 further comprising tension-taking trussing attached to the fly and extending between the first mentioned clip and the second clip for stabilizing the tent.

16. A tent as set forth in claim 13 wherein a sleeve of the shell overlies said pole, is held captive in the recess and is disposed between the pole and the clip.

17. A tent as set forth in claim 13 having a stop for inhibiting sliding movement of the clip relative to the pole.

18. A tent as set forth in claim 13 wherein the fly includes a patch overlying said pole, the recess in the clip receiving the patch, the overlying portion of the fly and said pole.

19. A tent as set forth in claim 18 having a stop on the patch for inhibiting sliding movement of the clip relative to the pole.

20. A tent as set forth in claim 13 wherein the body of the clip has holes therein for receiving guy lines and for receiving a tether.

21. A tent as set forth in claim 13 having a second clip received over the fly and over a second pole of the plurality of poles.

22. A fly for use with a tent having a fabric shell and a frame including a plurality of poles for supporting the shell in an erect configuration in which the shell encloses a space sized to accommodate one or more occupants, the fly comprising:

a fabric member sized and shaped to overlie the shell, a patch attached to the fabric member and disposed on the fabric member to overlie a pole of said plurality of poles, the patch being capable of conforming to a shape of said pole, and a clip having a recess for receiving and holding captive the patch, the fabric member and said pole thereby to secure the fly to the frame, the patch occupying sufficient volume in the recess to ensure a snug fit between the clip, the patch, the fabric member and said pole.

23. A fly as set forth in claim 22 wherein said pole has a generally circular cross-section and wherein the clip recess has a shape complementary to the cross-section of the pole, the patch being conformable to the shape of said pole when the patch, fabric member and pole are received in said clip recess.

24. A fly as set forth in claim 22 wherein the patch includes a stop for inhibiting movement of the clip along the pole.

25. A clip for attaching a fabric fly to a tent, said tent having a fabric shell and a frame comprising a plurality of poles for supporting the shell in an erect configuration in which the shell encloses a space sized to accommodate one or more occupants, the fabric fly being adapted to overlie the shell and frame, the fabric fly having a patch on an outside surface thereof, the clip comprising:

a body having opposite ends, a recess extending completely through the body from one end to the other end, and a slot extending the length of the body providing access to said recess, said slot and recess being sized and configured so that the clip can be moved into engagement with an outside surface of a portion of the fly overlying said pole and then pushed inwardly to cause said overlying portion of the fly and said pole to pass through the slot and into the recess to an overlying position in which the pole extends longitudinally through the body and said overlying portion of the fly is disposed between the pole and the body, said recess being generally C-shaped and sized so that when the clip is in said overlying position, constituting an initial position, the first pole and said overlying portion of the fly are held loosely in said recess, said clip being slidably movable along the first pole from said initial position to a final position in which said patch is also received in the recess and occupies a volume sufficient to prevent withdrawal of the pole and fly from the clip thereby to secure the fly to the pole.

26. A method of securing a fly in place overlying a tent, said tent comprising a fabric shell and a frame comprising a plurality of poles supporting the shell in an erect configuration in which the shell encloses a space sized to accommodate one or more occupants, said method comprising:

a) providing a clip comprising a body with opposite ends, a recess in the body extending completely through the body from one end to the other end, and a slot extending the length of the body providing access to said recess;

b) moving the clip into engagement with an outside surface of a portion of the fly overlying a pole of said plurality of poles;

c) pushing the clip inwardly toward the interior of the tent to cause said overlying portion of the fly and said pole to pass through the slot and into the recess to an initial position in which the pole extends longitudinally through the body and said overlying portion of the fly is disposed between the pole and the body; and d) sliding the clip along the pole to a final position in which a patch on the outside surface of the fly is also received in the recess and has sufficient volume to prevent withdrawal of the pole and fly from the clip thereby to secure the fly to the pole.

27. A method as set forth in claim 26 further comprising providing a second clip, moving the second clip into engagement with an outside surface of a portion of the fly overlying a second pole of said plurality of poles, pushing the clip inwardly toward the interior of the tent to cause said overlying portion of the fly and said second pole to pass through the slot and into the recess to an initial position in which the second pole extends longitudinally through the body and said overlying portion of the fly is disposed between the second pole and the body, and sliding the second clip along the second pole to a final position in which a second patch on the outside surface of the fly is also received in the recess and occupies volume sufficient to prevent withdrawal of the second pole and fly from the second clip thereby to secure the fly to the second pole and to increase the tension in the fly between the first mentioned clip and the second clip.

28. A tent comprising:

a fabric shell, a frame comprising a first pole and a second pole supporting the shell in an erect configuration in which the shell encloses a space sized to accommodate one or more occupants, one of said first and second poles crossing over the other of said first and second poles at a crossover point, a first sleeve receiving said first pole and attached to the shell, a second sleeve receiving said second pole and attached to the shell, and a connector connecting said first sleeve to said second sleeve and extending generally parallel to the shell at or generally adjacent said crossover point for stabilizing said first pole and second pole relative to one another, the connector comprising a flexible member having four corners, two of the corners being attached to said first sleeve on opposite sides of said crossover point and the other two corners being attached to the second sleeve at opposite sides of said crossover point.

29. A tent as set forth in claim 28, said flexible member comprising a quadrilateral fabric piece sewn to the first and second sleeves.

30. A tent comprising:

a shell, a frame comprising first and second poles extending over the shell holding the shell up in an erect configuration in which the shell encloses a living space, and a plurality of tensioned chords extending generally linearly between the first and second poles on the exterior of the shell to stabilize the tent, the tensioned chords capable of taking substantially only tension forces and not capable of taking substantial compression forces.

31. A tent as set forth in claim 30 wherein said tensioned chords extend along a plurality of walls of said tent.

32. A tent as set forth in claim 31 wherein at least one of said tensioned chords crosses over another of said tensioned chords on at least one of said walls.

33. A tent as set forth in claim 32 wherein the frame further comprises a third pole extending over the shell, at least one of said tensioned chords extending between said second and third poles.

34. A tent as set forth in claim 33 wherein the tensioned chords are guy lines.

35. A tent as set forth in claim 30 further comprising a plurality of hooks attached to the shell and securing said first and second poles to the shell, each hook including openings receiving the chords.

36. A tent as set forth in claim 35 wherein the hooks are J-shaped and include a gripping formation for gripping the pole.

37. A clip for attaching a fabric fly to a tent, said tent having a fabric shell and a frame comprising a plurality of poles for supporting the shell in an erect configuration in which the shell encloses a space sized to accommodate one or more occupants, the fabric fly being adapted to overlie the shell and frame, the clip comprising:

a body having opposite ends, a recess extending completely through the body from one end to the other end, and a slot extending the length of the body providing access to said recess, said slot and recess being sized and configured so that the clip can be moved into engagement with an outside surface of a portion of the fly overlying said pole and then pushed inwardly to cause said overlying portion of the fly and said pole to pass through the slot and into the recess to an overlying position in which the pole extends longitudinally through the body and said overlying portion of the fly is disposed between the pole and the body, the body including two jaws defining the recess therebetween, the jaws being movable relative to one another from an open position in which the jaws are spaced apart to define said slot and the clip is movable to said overlying position, and a clamped position of the clip in which the jaws are closer than in the open position, the clip further comprising a locking mechanism for locking the jaws in said clamped position to prevent withdrawal of the pole and fly from the clip thereby to secure the fly to the pole.

* * * * *